US011391075B2

(12) United States Patent
Montecchio et al.

(10) Patent No.: US 11,391,075 B2
(45) Date of Patent: Jul. 19, 2022

(54) SLIDING DOOR FITTING

(71) Applicant: HETTICH-HEINZE GMBH & CO. KG, Spenge (DE)

(72) Inventors: Andreas Montecchio, Bad Salzuflen (DE); Felix Waterbör, Bielefeld (DE)

(73) Assignee: HETTICH-HEINZE GMBH & CO. KG, Spenge (DE)

( * ) Notice: Subject to any disclaimer, the term of this patent is extended or adjusted under 35 U.S.C. 154(b) by 474 days.

(21) Appl. No.: 16/476,441

(22) PCT Filed: Jan. 3, 2018

(86) PCT No.: PCT/EP2018/050119
§ 371 (c)(1),
(2) Date: Jul. 8, 2019

(87) PCT Pub. No.: WO2018/127508
PCT Pub. Date: Jul. 12, 2018

(65) Prior Publication Data

US 2021/0010309 A1 Jan. 14, 2021

(30) Foreign Application Priority Data

Jan. 9, 2017 (DE) ..... 10 2017 100 250.2

(51) Int. Cl.
*E05F 1/08* (2006.01)
*E05D 15/06* (2006.01)
*E05F 5/00* (2017.01)

(52) U.S. Cl.
CPC ..... *E05D 15/063* (2013.01); *E05D 15/0652* (2013.01); *E05F 5/003* (2013.01);
(Continued)

(58) Field of Classification Search
CPC ..... E05F 5/003; E05F 5/05; E05F 1/08; E05F 1/1091; E05F 1/16; E05F 3/00;
(Continued)

(56) References Cited

U.S. PATENT DOCUMENTS 5,678,280 A * 10/1997 Haab ..... E05D 15/0656 16/87.6 R
8,418,406 B2 4/2013 Zimmer et al.
(Continued)

FOREIGN PATENT DOCUMENTS

CN 202227849 U * 5/2012 ..... E05F 5/00
CN 203796045 U * 8/2014 ..... E05F 5/00
(Continued)

OTHER PUBLICATIONS

Seach Report issued in German App. No. 102017100250.2 (dated 2017).
(Continued)

*Primary Examiner* — Chuck Y Mah
(74) *Attorney, Agent, or Firm* — Barnes & Thornburg LLP

(57) ABSTRACT

The invention relates to a sliding door fitting comprising a carriage, which is guided on a guide rail and which is connected to a housing of a retraction device in an articulated manner, wherein the retraction device has at least one, preferably two driver elements, which can be moved along guide tracks and which are spaced apart, the one or more driver elements being preloaded into a retraction position by means of at least one force accumulator, wherein the housing of the retraction device is preloaded in a direction rotation relative to the carriage.

12 Claims, 9 Drawing Sheets

(52) U.S. Cl.
CPC ..... *E05Y 2201/21* (2013.01); *E05Y 2201/48* (2013.01); *E05Y 2201/482* (2013.01); *E05Y 2201/492* (2013.01); *E05Y 2201/64* (2013.01); *E05Y 2900/132* (2013.01)

(58) Field of Classification Search
CPC ..... E05F 3/02; E05F 3/04; E05F 3/18; E05F 3/227; E05F 3/22; E05F 3/10; E05F 3/108; E05F 3/224; E05Y 2800/24; E05Y 2201/64; E05Y 2201/644; E05Y 2201/264; E05Y 2201/41; E05Y 2201/47; E05Y 2201/21; E05Y 2201/488; E05Y 2201/48; E05Y 2201/482; E05Y 2201/492; E05Y 2900/132; E05Y 2900/142; E05Y 2900/14; Y10T 16/27; Y10T 16/56; Y10T 16/61; Y10T 16/593; Y10T 16/276; Y10T 16/281; E05D 15/063; E05D 15/0652
See application file for complete search history.

(56) References Cited

U.S. PATENT DOCUMENTS

| | | | | |
|---|---|---|---|---|
| 9,765,559 | B2 * | 9/2017 | Shin | E06B 3/4636 |
| 10,151,130 | B2 * | 12/2018 | Wang | E05F 5/003 |
| 2007/0033877 | A1 | 2/2007 | Goebel et al. | |
| 2011/0023370 | A1 * | 2/2011 | Zimmer | E05F 1/16 49/360 |
| 2017/0114582 | A1 * | 4/2017 | Ishikawa | E05F 5/003 |
| 2017/0198510 | A1 * | 7/2017 | Shin | E06B 3/4636 |
| 2017/0198511 | A1 | 7/2017 | Shin | |
| 2018/0371815 | A1 * | 12/2018 | Intelmann | E05F 5/003 |

FOREIGN PATENT DOCUMENTS

| | | | | |
|---|---|---|---|---|
| DE | 102008009046 | | 9/2009 | |
| DE | 202014009249 | U1 * | 12/2014 | E05F 5/00 |
| DE | 102013114309 | | 6/2015 | |
| DE | 202017100244 | U1 * | 1/2017 | E05F 1/16 |
| EP | 3088649 | | 11/2016 | |
| GB | 659625 | A * | 10/1951 | E05D 15/063 |
| JP | 2018119390 | A * | 8/2018 | E05D 15/063 |
| KR | 101548488 | | 8/2015 | |
| KR | 101661080 | | 9/2016 | |
| WO | 2005028794 | | 3/2005 | |
| WO | WO-2006011294 | A1 * | 2/2006 | E05F 5/003 |

OTHER PUBLICATIONS

Search Report issued in Int'l App. No. PCT/EP2017/050119 (dated 2018).

* cited by examiner

SLIDING DOOR FITTING

CROSS-REFERENCE TO RELATED APPLICATIONS

This application is a U.S. nationalization under 35 U.S.C. § 371 of International Application No. PCT/EP2018/050119, filed Jan. 3, 2018, which claims priority to German Patent Application No. 102017100250.2, filed Jan. 9, 2017. The disclosures set forth in the referenced applications are incorporated herein by reference in their entireties.

BACKGROUND AND SUMMARY OF THE DISCLOSURE

The present disclosure is directed to a sliding door fitting having a carriage guided on a guide rail, which carriage is connected in an articulated manner to a housing of a retraction device, wherein the retraction device has at least one, or at least two, spaced drivers which can be moved along guideways and which is or are pretensioned into a retraction position via at least one energy accumulator.

DE 10 2008 009 046 A1 discloses a sliding door arrangement having an acceleration and deceleration device comprising first and second driving elements which are pretensioned in a retraction direction via an energy accumulator. The two driving elements are connected by a tension spring and can each move a sliding door to one end position, so that it is possible to move to two different end positions. The problem with such an acceleration and deceleration device is that the driving elements generate damping forces when a guide part is engaged, which act in different directions depending on the end position. This allows the housing to be moved relative to the guide rail until the housing strikes the guide rail, causing annoying noises. In addition, the striking of the housing can cause material stress.

In illustrative embodiments of a sliding door fitting according to the present disclosure, a carriage is connected in an articulated manner to a housing of a retraction device, wherein the housing of the retraction device is pretensioned in one direction of rotation relative to the carriage. This allows impact loads on the drivers to be absorbed without the housing making a stop noise on the guide rail because the pretensioning of the housing in one direction of rotation relative to the carriage means that the carriage and housing can be held in a defined position on or in the guide rail. The forces to pretension the housing relative to the carriage are greater than the impact forces to be expected from the damper when braking the sliding door.

In illustrative embodiments, at least one roller on the side facing away from the carriage is provided on the housing of the retraction device, which rests with a pretension against a guideway of the running rail. This not only allows the housing to move in a sliding fashion along the guide rail but also over the roller, which ensures a defined position of the housing within the guide rail. The roller allows the housing to be moved smoothly along the guide rail.

In further illustrative embodiments, each driver can be coupled to an activator which is fixed to or in the running rail. For example, the activator may be fixed in the running rail, for example via a clamping screw, wherein each activator is adjustable in the longitudinal direction of the running rail so that the retraction position and the retraction path of the driver can be adapted to the respective application.

In illustrative embodiments, each driver can be placed in a parking position when the energy accumulator is tensioned, and the driver or drivers is or are braked by at least one damper in the retraction direction. This improves the movement of a sliding door coupled to the driver.

A rubber-elastic element may be provided to pretension the housing of the retraction device relative to the carriage. For pretensioning, a screw can be provided to compress the rubber-elastic element, which compresses said element and thus generates a torque between the housing and the carriage.

Instead of a pretension via a rubber-elastic element or another elastic element, a leaf spring or a spiral spring may also be provided between the housing and the retraction device. The spring can be located either directly in the connection area between the housing and the carriage or in another position of the housing.

For an articulated connection of the housing to the carriage, an axle on the carriage may be gripped by a holder at one end of the housing of the retraction device, for example, the holder may form a bearing receptacle for the axle to which one or more rollers of the carriage may be fixed.

In illustrative embodiments, two spaced-apart carriages may be provided, between which the housing of the retraction device is arranged. The retraction device may have a single energy accumulator, which couples the two drivers together. In illustrative embodiments, two dampers may be provided so that a single damper for each driver can slow down the retraction movement of the driver.

Figures 1A, 1B, 1C:
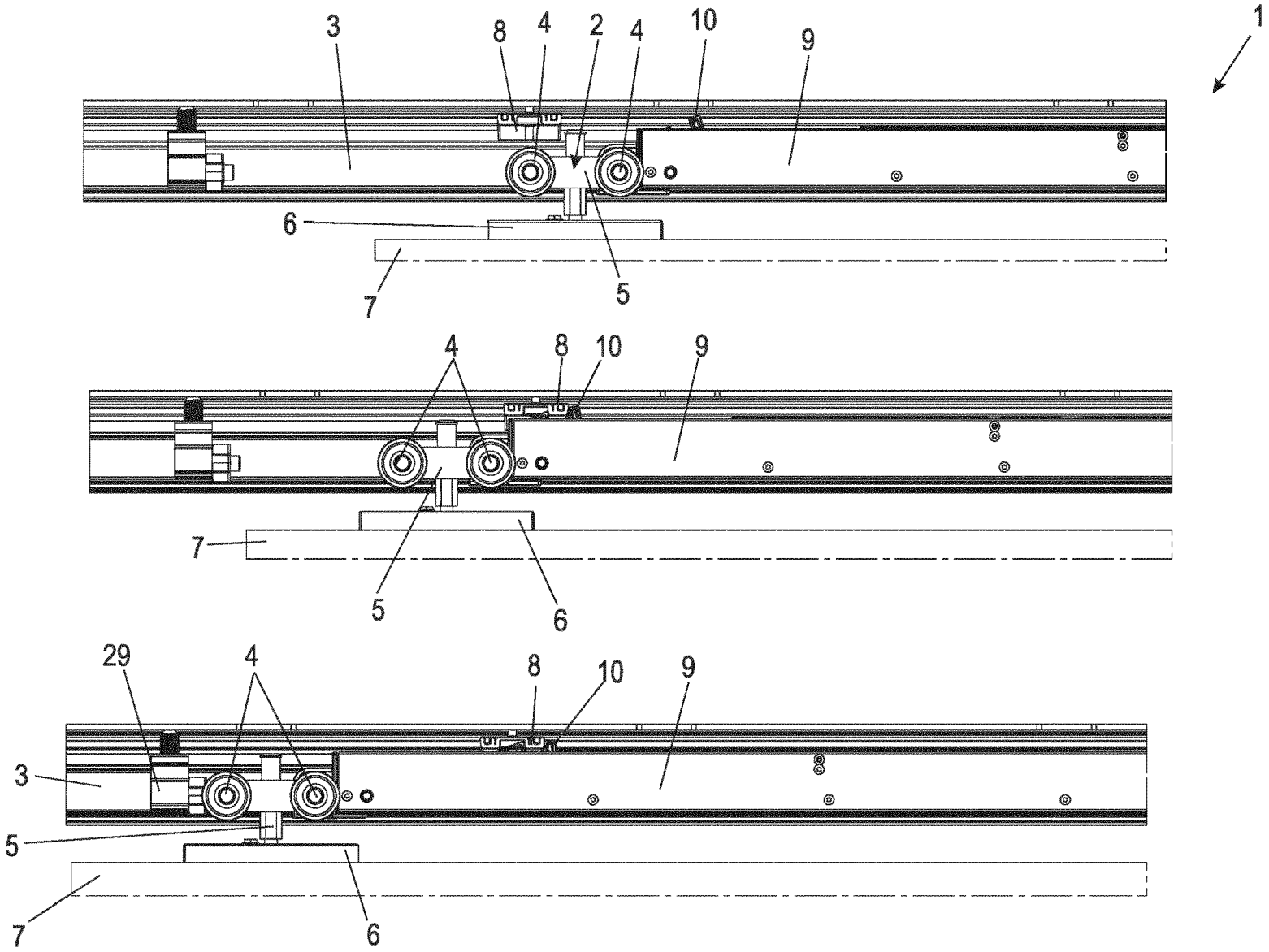
FIGS. 1A to 1C show several views of an illustrative sliding door fitting including a retraction device according to the present disclosure during a retraction movement.

An illustrative sliding door fitting 1 comprises a guide device 2 with two mutually spaced carriages 5 which can be moved along a guide rail 3 by means of track rollers 4. The two carriages 5 can have a holder 6 on the underside to which a sliding door 7 or a folding sliding door is fixed in a suspended manner. The sliding door 7 can be moved to different end positions. In order to brake the sliding door 7 shortly before reaching an end position and to retract it in an end position, a retraction device is provided which has a housing 9 which is arranged between two carriages 5 of the sliding door fitting. Two mutually spaced drivers 10 are displaceably mounted on the housing 9, which can each come into engagement with a stationary activator 8 fixed to the guide rail 3.

FIG. 1A shows a position of sliding door 7 where the retraction device is inactive and sliding door 7 can be moved unbraked along guide rail 3 via carriages 5. If the sliding door 7 is now moved further to the left end position according to FIG. 1B, the driver 10 of the retraction device comes into engagement with the stationary activator 8, and the driver 10 is moved out of a parking position. The driver 10 is then moved along a guideway by an energy accumulator, wherein the movement of the driver 10 is braked by a damper so that the sliding door 7 approaches an end position in a controlled manner. In FIG. 1C, the sliding door has reached the end position where the carriage 5 or a track roller 4 rests against a stop 29.

Figure 2:
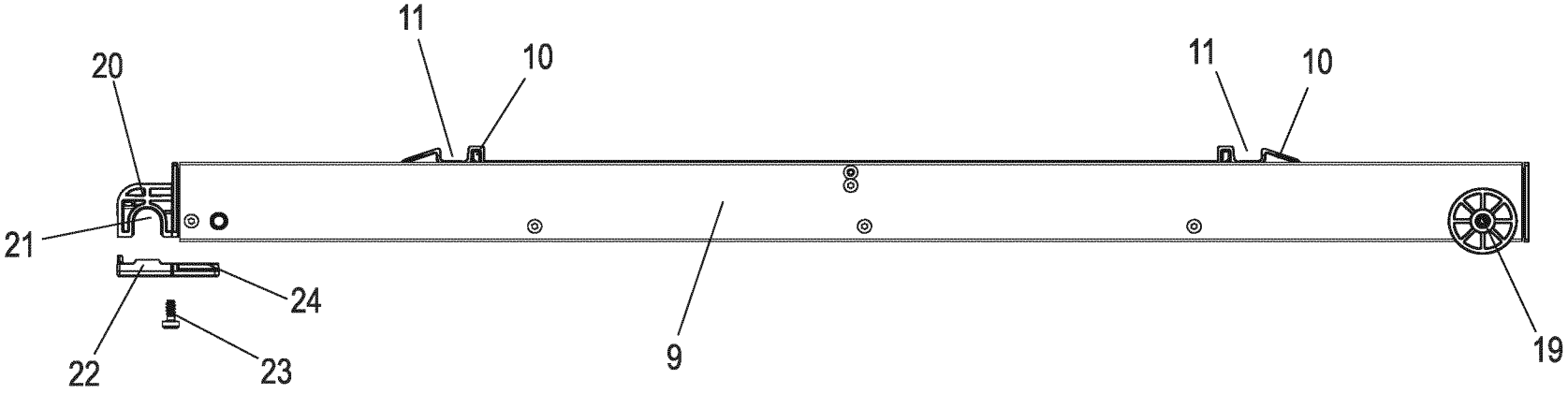
FIG. 2 shows a view of a retraction device apart from the sliding door fitting.

FIG. 2 shows the retraction device apart from the sliding door fitting. The retraction device comprises an elongated housing 9, on which two mutually spaced drivers 10 can be moved. Each driver 10 has a groove-shaped receptacle 11, into which a projection of the activator 8 can be inserted. A holder 20 is provided on one side of the housing 9, which has a receptacle 21 that can be coupled to the carriage 5 to connect the housing 9 to the carriage 5 in an articulated manner. The receptacle 21 on the hook-shaped holder 20 is closed with a closure element 22, which can be placed against the housing 9 with a section 24 and fixed with a screw 23. A roller 19 is provided on the side opposite the holder 20, by means of which the housing 9 is movably mounted on the guide rail 3.

Figure 3A:
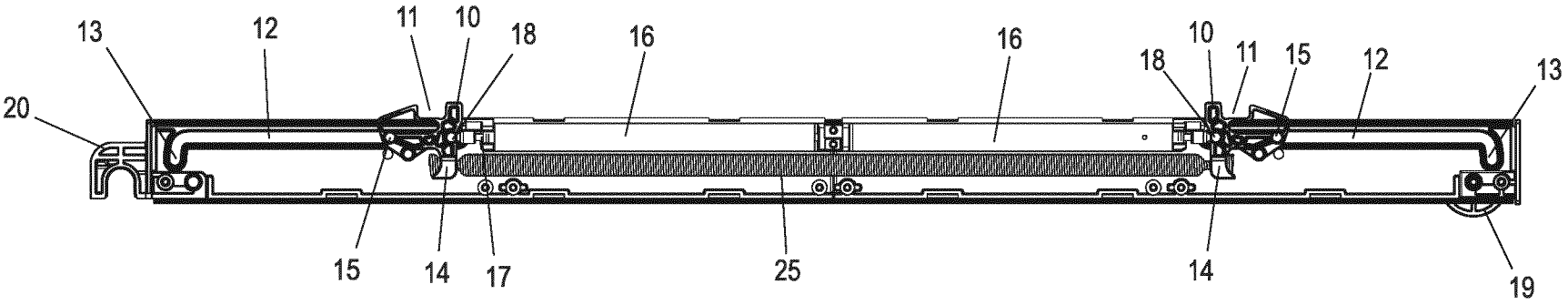
FIGS. 3A and 3B show two views of the retraction device with partially removed housing in different positions.

FIG. 3A shows the retraction device with the housing partially removed, wherein the drivers 10 are each arranged in the end position. Each driver 10 is guided via pin 15 in a guideway 12 which has an angled end section 13. If a front pin 15 reaches the angled end section 13, the driver 10 can be parked and locked against the force of the energy accumulator 25. The energy accumulator 25 is designed as a tension spring, which is tensioned between the two drivers 10, wherein a spring holder 14 is formed on each driver 10. Furthermore, each driver 10 is coupled to a damper 16, wherein a damper housing is fixed to a receptacle of a housing part and the damper 16 is connected to the driver 10 by a coupling element 18.

Figure 3B:
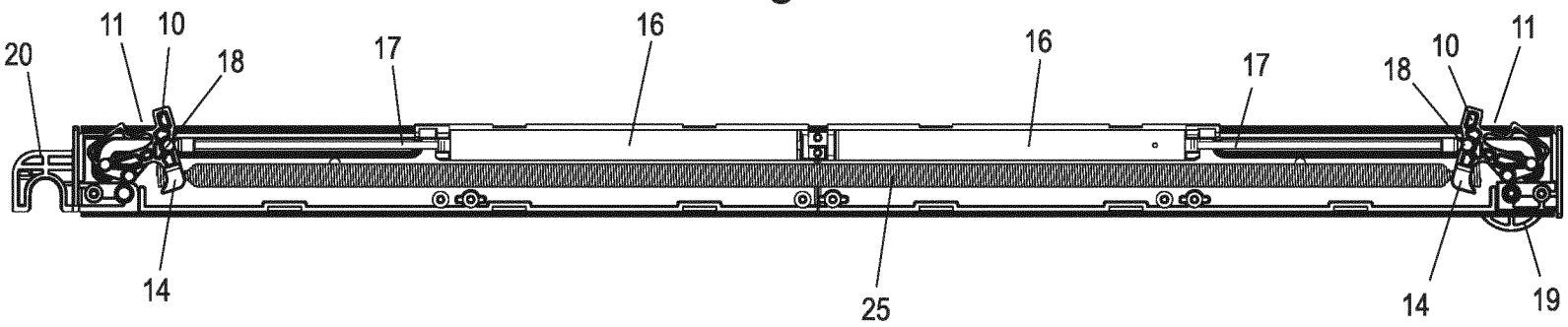

FIG. 3B shows the two drivers 10 in the parking position with tensioned energy accumulator 25. In this position, the dampers 16 are also extended so that a piston rod 17 is visible, which can be retracted into one damper housing to generate damping forces. The damper 16 can be designed as a fluid damper or a gas pressure damper. Instead of the positions shown in FIGS. 3A and 3B, only one driver 10 may be locked in a parking position at the angled end section 13, while the opposite driver 10 is arranged in an end position.

Figure 4B:
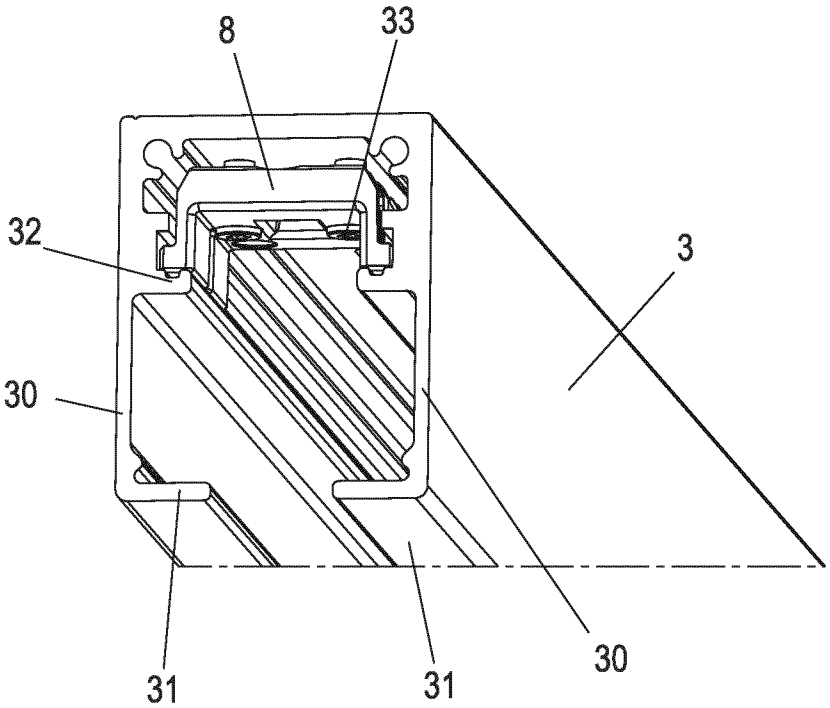
FIGS. 4A and 4B show two views of the guide rail of the sliding door fitting with an activator.
Figure 4A:
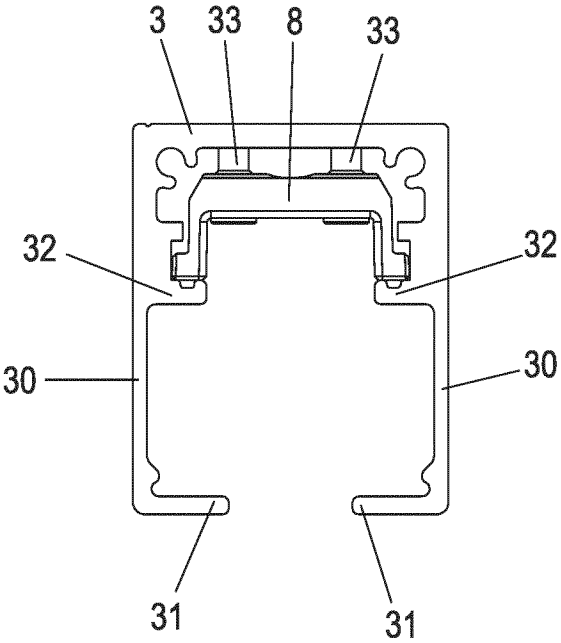

FIGS. 4A and 4B show the guide rail 3 used to guide the carriages 5 and the retraction device. The guide rail 3 has an essentially U-shaped cross-section with two legs 30 pointing downwards, which are provided with inwardly directed webs 31 at the ends. On the upper side of the webs 31 there are guideways for four track rollers 4 of a carriage 5. There are also inwardly directed webs 32 on the limbs in a central area above the track rollers 4 to limit lifting of the carriage 5. The activator 8 is fixed in a chamber above the webs 32 and interacts with a driver 10 of the retraction device. The activator 8 is fixed in the guide rail 3 by clamping screws 33.

Figure 5:
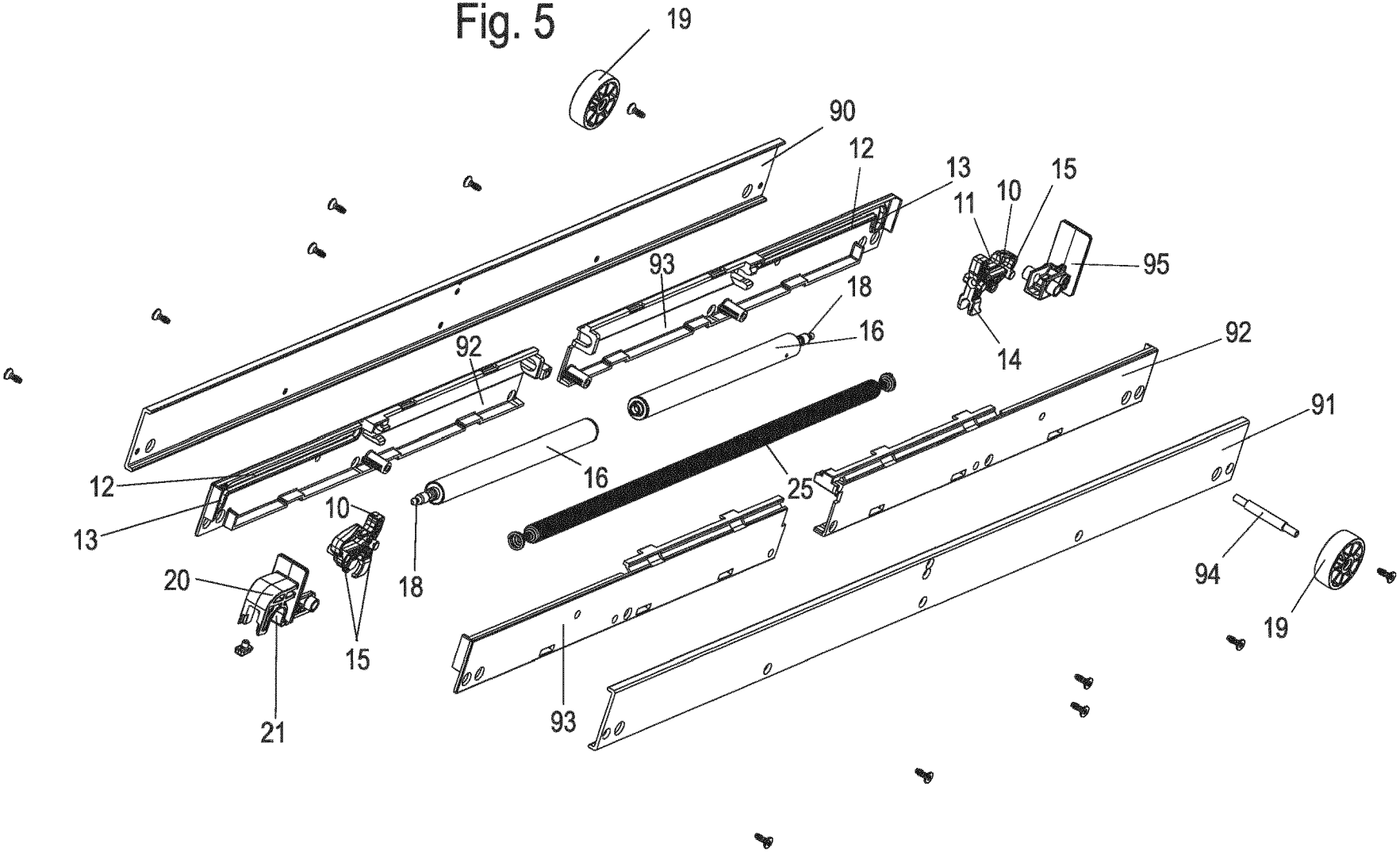
FIG. 5 shows a perspective exploded view of the retraction device of the sliding door fitting.

In FIG. 5, the retraction device is shown in a perspective exploded view. The retraction device comprises a housing with two outer housing parts 90 and 91, on which inner housing parts 92 and 93 are provided. The two housing parts 92 and the two housing parts 93 each have guideways 12 with a linear section and an angled end section 13, on each of which a driver 10 is guided. On each inner housing part 92 and 93 there is a receptacle for fixing one housing of the damper 16. Adjacent to the receptacle for the damper 16, a receptacle for the energy accumulator 25 is provided. The energy accumulator 25, which is designed as a spring, is connected at each end via a spring holder 14 to a driver 10. The housing 9 is closed at one end with a cap 95, on each end of which a bearing for an axle 94 is provided for the two rollers 19. The rollers 19 are thus rotatably mounted on the housing 9. On the opposite side the holder 20 with the receptacle 21 is provided on the housing.

Figure 6A:
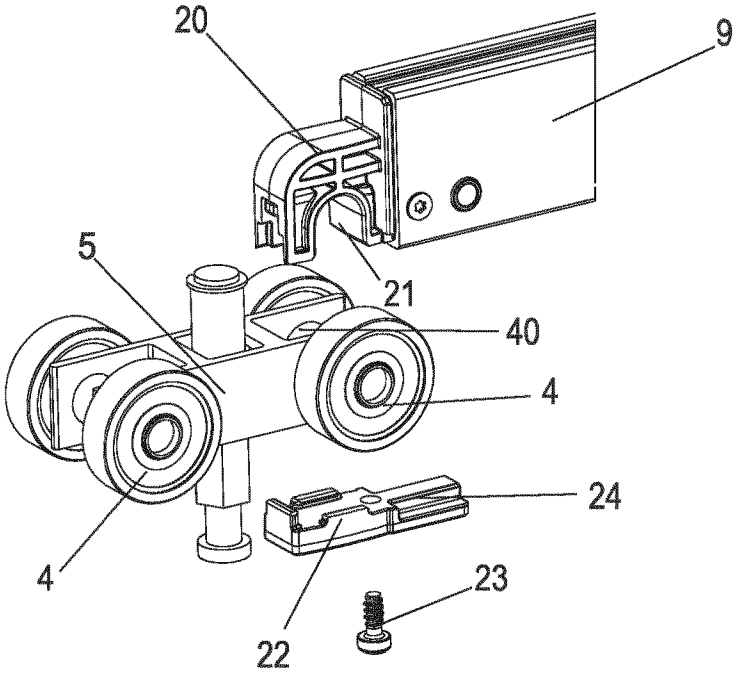
FIGS. 6A and 6B show two views of the connection area between the carriage and the housing of the retraction device.
Figure 6B:
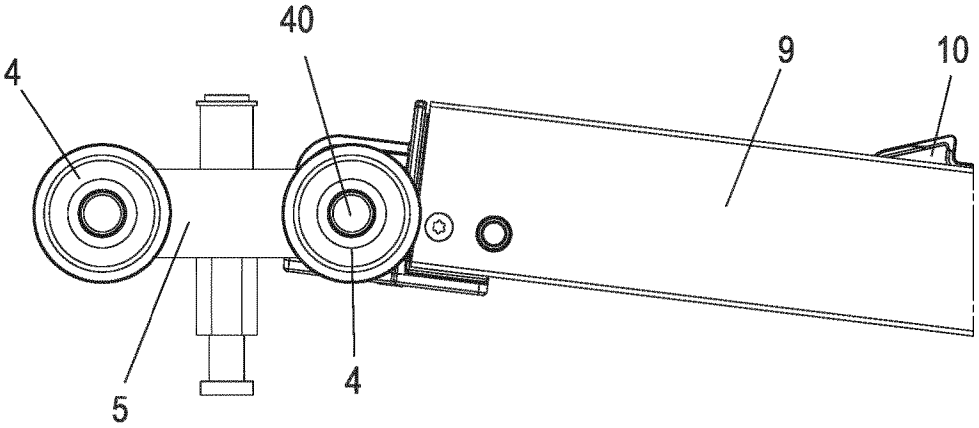

FIGS. 6A and 6B show a connection area between the carriage 5 and the housing 9 of the retraction device. The carriage 5 comprises four track rollers 4, which are connected to each other in each case by an axle 40. The holder 20 engages on one side between the two track rollers 4 and engages around the axle 40, which is inserted into the receptacle 21. Thus the holder 20 forms a bearing to connect the housing 9 in an articulated manner to the carriage 5. The bearing with the receptacle 21 is closed by the closure element 22, which is fixed to the housing 9 or the holder 20 by means of a screw 23. For the articulated connection of the housing 9 relative to the carriage 5, a mobility of a few degrees is sufficient, for example between 1° and 5°.

Figure 7A:
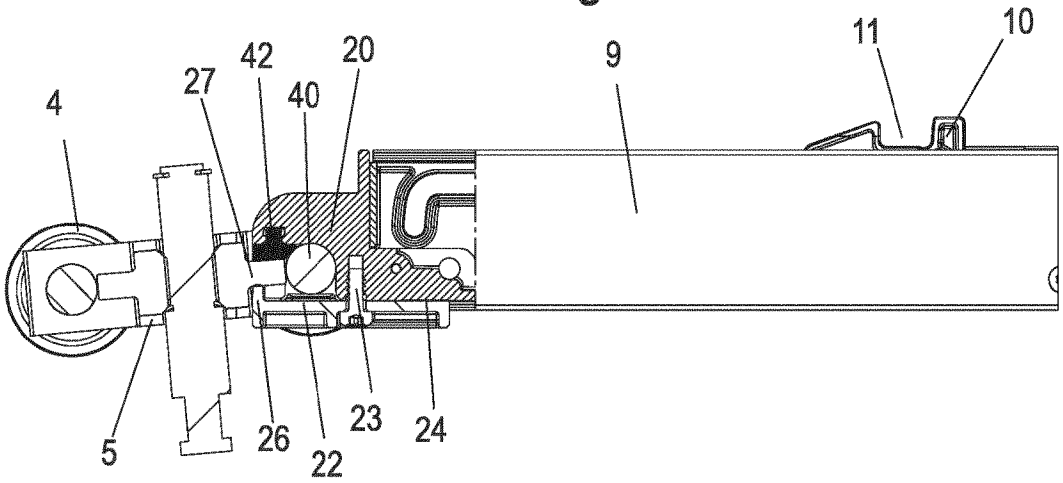
FIGS. 7A and 7B show two views of the connection area according to FIG. 6 partly in section.
Figure 7B:
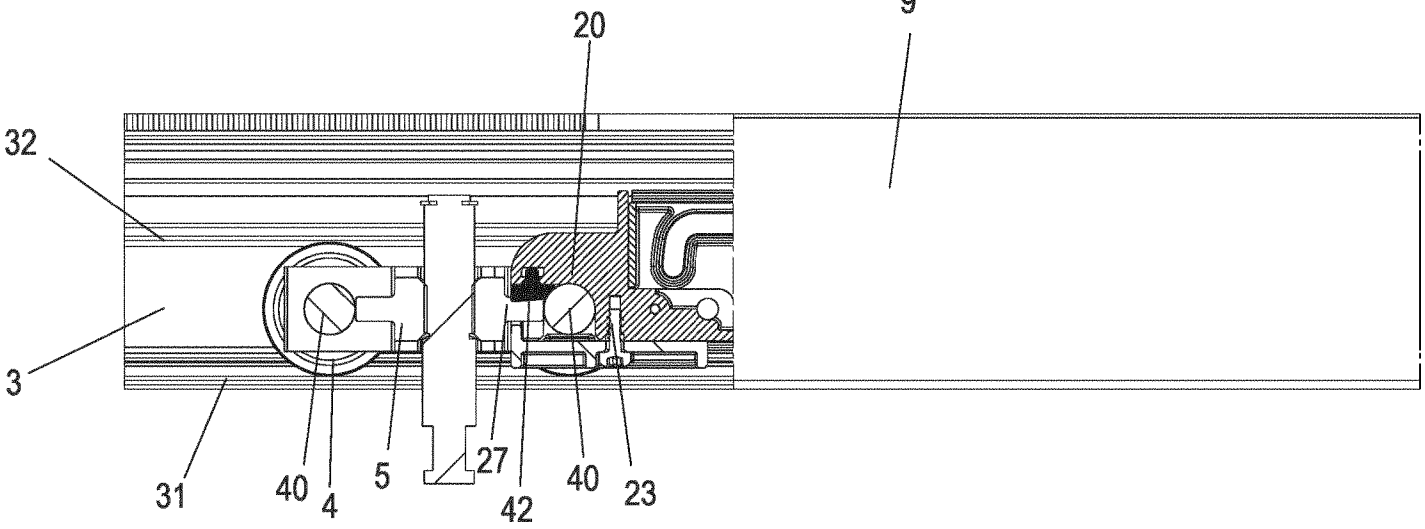

FIGS. 7A and 7B show a sectional view of the connection area between the housing 9 and the carriage 5. The carriage 5 is supported on the lower webs 31 by the track rollers 4. The holder 20 has an elastic or rubber-element 42 adjacent to the axle 40, for example made of a foamed material, which is compressed by the closure element 22, which presses on a web 27 of the carriage 5 via an upwardly projecting web 26, thereby compressing the compressible element 42. As a result of this compression by means of the closure element 22 and the screw 23, the housing 9 of the retraction device is pretensioned relative to the carriage 5 with a torque. This pretensioning of the housing 9 of the retraction device has the advantage that the housing 9 is not pivoted within the guide rail 3, which can lead to stop noises. In a first direction of rotation, the housing 9 is supported anyway by the roller 19, which rolls on one of the webs 31 or 32. In the opposite direction, the torque provided by the compressible element 42 ensures that the housing 9 is pretensioned relative to the carriage 5 so that in the event of damping forces exerted by one of the drivers 10, the housing 9 does not pivot and strike within the guide rail 3.

Figure 8A:
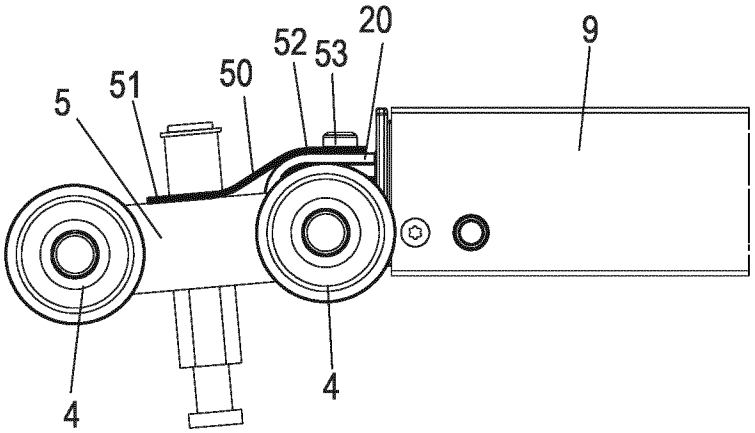
FIGS. 8A and 8B show two views of a modified embodiment example of a sliding door fitting according to the present disclosure.
Figure 8B:
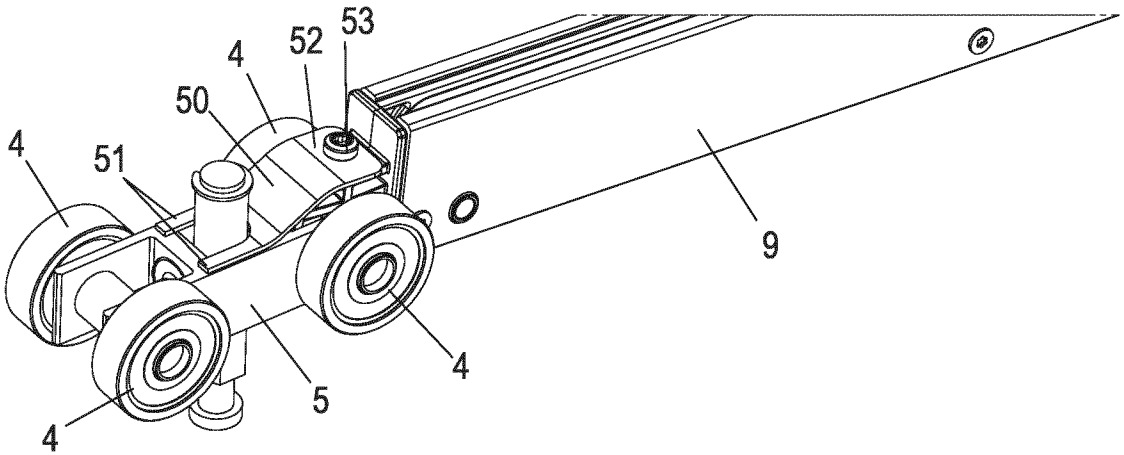

The pretension of the housing 9 relative to the carriage 5 can also be carried out via other spring elements. FIGS. 8A and 8B show an embodiment in which a leaf spring 50 is provided between the carriage 5 and the housing 9. The leaf spring 50 is supported by two webs 51 on an upper side of the carriage 5. On the opposite side, the leaf spring 50 is fixed to the holder 20 with a section 52 and clamped by a screw 53. By tightening the screw 53 the leaf spring 50 pretensions the housing 9 in one direction of rotation relative to the carriage 5.

Figure 9A:
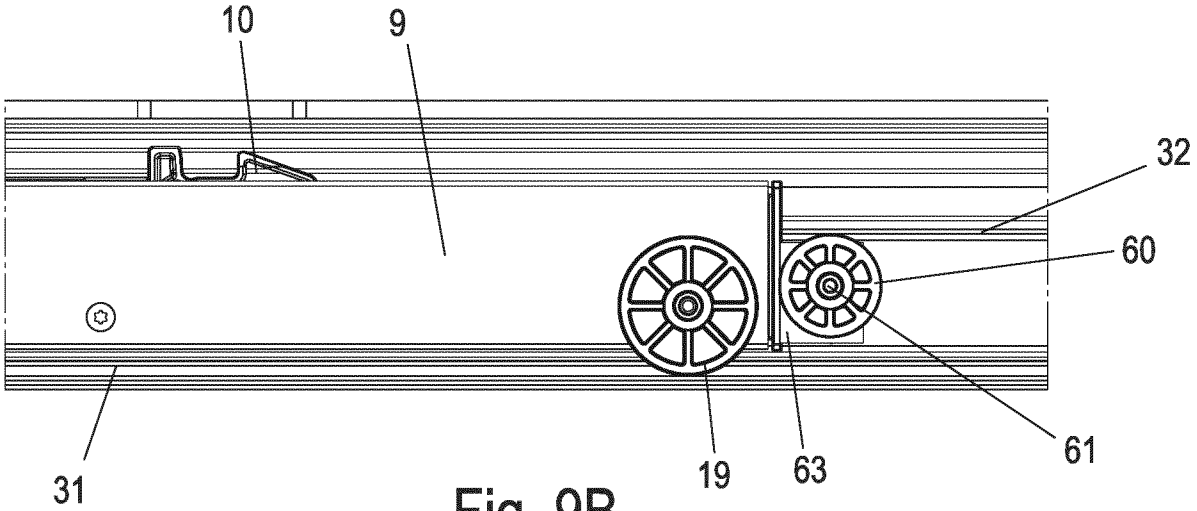
FIGS. 9A and 9B show two views of another embodiment of a sliding door fitting.
Figure 9B:
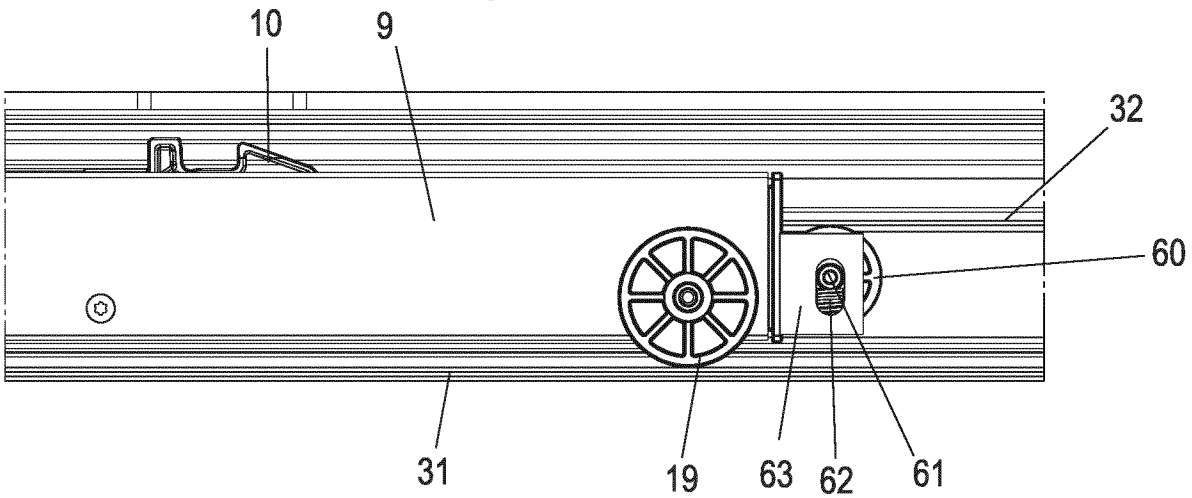

A spring force can be applied additionally or alternatively via a spring element which is provided at a distance from the carriage 5. FIGS. 9A and 9B show the housing 9 of the retraction device at the end facing away from the carriage 5. Roller 19 is guided on a lower web 31 of guide rail 3, while an additional guide roller 60 unrolls on a web 32 of guide rail 3. The guide roller 60 is mounted around an axle 61, which can be moved perpendicular to the longitudinal direction of the guide rail 3. For this purpose, axle 61 is pretensioned against web 32 by a spring 62, as shown in FIG. 9B in particular. On the end of the housing 9 a holder 63 for the guide roller 60 is provided, which is spring-loaded and thus prevents the housing 9 from being pivoted against the force of the spring 62, even if one of the two drivers 10 is braked by an activator 8 and a torque is introduced into the retraction device.

The invention claimed is:

1. A sliding door fitting having a first carriage guided on a guide rail, wherein the first carriage is connected in an articulated manner to a housing of a retraction device, wherein the retraction device has at least one driver which can be moved along a guideway defined by the housing of the retraction device and which is pretensioned into a retraction position via at least one energy accumulator, wherein the housing of the retraction device is pretensioned in a first direction of rotation relative to the first carriage, the sliding door fitting further comprising an elastic element operably associated with the housing of the retraction device and the first carriage and configured to pretension the housing of the retraction device in the first direction of rotation relative to the first carriage, and an adjusting element configured to variably deflect the elastic element in order to apply a torque to the housing relative to the carriage.

2. The sliding door fitting according to claim 1, wherein at least one roller is provided on the housing of the retraction device on an end remote from the first carriage, which roller is pretensioned and rests against a guideway of the guide rail.

3. The sliding door fitting according to claim 1, wherein the driver can be parked and locked against the force of the energy accumulator when the energy accumulator is tensioned.

4. The sliding door fitting according to claim 1, wherein the driver can be coupled to an activator which is fixed in the guide rail.

5. The sliding door fitting according to claim 4, wherein the activator is fixable to the guide rail in plural locations with respect to the longitudinal direction of the guide rail.

6. The sliding door fitting according to claim 1, wherein an axle of the carriage is enclosed by an end of the housing of the retraction device by a holder.

7. The sliding door fitting according to claim 1, wherein a leaf spring or a spiral spring is provided for pretensioning the housing of the retraction device.

8. The sliding door fitting according to claim 1 further comprising a second carriage, wherein the housing of the retraction device is arranged between the first carriage and the second carriage.

9. The sliding door fitting according to claim 1, further comprising a second driver spaced apart from the driver, wherein the driver and the second driver are connected to one another via a single energy accumulator.

10. The sliding door fitting according to claim 9, wherein the driver and the second driver are braked in the retraction direction by at least one damper.

11. The sliding door fitting according to claim 10, wherein the at least one damper comprises a first damper and a second damper two dampers provided in the housing of the retraction device wherein the first damper is configured to brake the first driver, and where the second damper of the two dampers is configured to brake the second driver.

12. The sliding door fitting of claim 1, wherein the driver is braked in the retraction direction by at least one damper.

* * * * *